United States Patent [19]

Kilian

[11] 4,373,946

[45] Feb. 15, 1983

[54] PROCESS OF HEAT-TREATING PELLETS

[75] Inventor: Alois Kilian, Frankfurt am Main, Fed. Rep. of Germany

[73] Assignee: Dravo Corporation, Pittsburgh, Pa.

[21] Appl. No.: 214,525

[22] Filed: Dec. 8, 1980

[30] Foreign Application Priority Data

Dec. 8, 1979 [DE] Fed. Rep. of Germany ..... 2949418

[51] Int. Cl.[3] ..... C22B 1/20

[52] U.S. Cl. ..... 75/5; 432/8; 432/14; 432/72; 432/137

[58] Field of Search ..... 75/3–5; 432/8, 14, 72, 137

[56] References Cited

U.S. PATENT DOCUMENTS

| | | | |
|---|---|---|---|
| 1,896,884 | 2/1933 | Cooper et al. | 75/5 |
| 3,042,390 | 7/1962 | Rausch et al. | 75/5 |
| 4,181,520 | 1/1980 | Reuter et al. | 75/3 |

FOREIGN PATENT DOCUMENTS

| | | | |
|---|---|---|---|
| 682991 | 3/1964 | Canada | 75/5 |

OTHER PUBLICATIONS

Ball, D. F., et al; *Agglomeration of Iron Ores* Am. Elsevier Pub. Co., Inc., N.Y. pp. 170–177, 349–355, Plate 3, (1973).

*Primary Examiner*—Michael L. Lewis

*Attorney, Agent, or Firm*—Parmelee, Miller, Welsh & Kratz

[57] ABSTRACT

An improved process for heat-treating pellets in a pelletizing machine in which hot gases are generated and passed through a bed of pellets includes charging solid carbonaceous fuel onto the surface of the pellet bed and burning the carbonaceous fuel to generate at least a portion of the hot gases.

9 Claims, 4 Drawing Figures

PROCESS OF HEAT-TREATING PELLETS

FIELD OF THE INVENTION

This invention relates to a process of heat-treating pellets on a pelletizing machine in which hot gases are passed through a pellet bed, solid carbonaceous fuel is burnt to generate at least part of the hot gases, cooling gases are passed through the pellets to cool them and at least part of the heated cooling gases is fed to the heat-treating zone.

BACKGROUND OF THE INVENTION

The heat-treatment of pellets, particularly the firing of iron ore pellets to harden them is effected in most cases on traveling grates which are provided with gas hoods and described as pellet-firing machines. Such pellet-firing machines consist of several zones, which succeed each other in the direction of travel, namely, a drying zone, a heat-treating zone and a cooling zone. These zones may be subdivided, for instance, into pre-drying and final drying sections, a preheating section, a preliminary firing section, a main firing section and an afterfiring section, and first and second cooling zone sections. In most cases, all or most of the process heat which is required is introduced into the process by hot gases. These hot gases are generated in gas hoods provided over the pellet bed by a combustion of liquid, gaseous or dustlike solid fuels or they are collected and distributed by such hoods. As part of the exhaust gases are very hot, various gas-recycling systems are used for utilization of heat.

Such a pellet-firing machine is known from German Patent Specification 1,433,339. In that machine, hot cooling gas from an updraft first cooling zone section is conducted in a common gas hood without an interposed blower into the heat-treating zone, which consists of preheating, firing and afterfiring sections. The cooling gas is distributed to the several sections of the heat-treating zone by means of internal fixtures provided in the common gas hood. These internal fixtures define passages leading to the actual combustion chambers of the several zone sections. In the combustion chambers of the preheating and firing sections, the hot cooling gases are heated up by burners to the required temperature. The hot gases are sucked through the bed into windboxes. Gases from the second cooling zone section and exhaust gases from the afterfiring section are fed into the drying zone sections. It is also described that the hot cooling gases from a gas hood disposed over the cooling zone are withdrawn through a gas manifold and are distributed via distributing ducts to the several sections of the heat-treating zone.

In a similar pellet-firing machine known from U.S. Pat. No. 3,620,519, the hot cooling gases are heated up by burners in the common gas hood over the cooling zone and/or in the transition zone between the cooling and heat-treating zones. An internal fixture for shielding the pellets from the hot combustion gases is installed at least in part of the transition zone in the common gas hood disposed over the pellet bed. The use of burners to supply all heat that is required may give rise to an occurrence of hot spots, where ash from the fuel and/or dust contained in the process gases may be transformed into slag and form crusts adjacent to the burners. These crusts may deflect the flames or may permit an infiltration of ash whereby the refractory material may be destroyed. This may also adversely effect the heat treatment or may decrease the throughput or may necessitate repairs requiring the plant to be shut down. Besides, pellet-firing machines provided with burners require a very large number of burners so that these machines are mainly desirable for the use of gaseous and liquid fuels, which are relatively expensive. Where pulverized-coal burners are used, it is desirable to decrease the number of burners because special means are required to convey and distribute the fuel.

It is also known to incorporate part of the required fuel in the pellets although only a small part of the fuel can be incorporated without adversely affecting the quality of the pellets.

It is an object of the invention to avoid or substantially to decrease the occurrence of hot spots and the resulting problems due to slagging and decreased durability. Besides, it is also desirable to permit the use of inexpensive fuel and to provide a process with which the operation of existing plants can be improved.

SUMMARY OF THE INVENTION

In accordance with the present invention at least 10% of the fuel which is supplied to the process from the outside is fed as solid fuel onto the surface of the pellet bed.

The total heat which is required is supplied as recycled process heat in the recycled gas plus the heat content of any fuel incorporated in the pellets plus any heat of reaction (for instance, the heat evolved by the oxidation from $Fe_3O_4$ to $Fe_2O_3$) plus the heat content of fuel supplied to the process from the outside. The feature "at least 10%" relates to that fuel supplied from the outside. All kinds of coal may be used as solid fuel, even those having a high content of volatile constituents. The particle size distribution of the solid fuel, its rate and the location of its feeding points are so selected that heat at the desired rate is available in each zone and each section and that the material which is discharged does not contain solid fuel and hot spots are avoided as far as possible. In these selections, the reactivity of the solid fuel and its content of volatile constitutents must be taken into account where other conditions are the same. The solid fuel may be fed by mechanical or pneumatic feeders. The remainder of the fuel supplied "from the outside" is fed in a conventional manner by means of burners for firing liquid or gaseous fuel or pulverized coal.

DETAILED DESCRIPTION OF THE INVENTION

Figure 2:
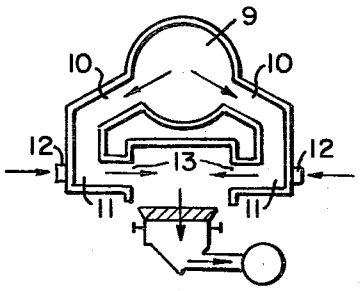
FIG. 2 is a cross sectional diagrammatic view of a pellet firing machine along lines II—II of FIG. 1.

At least a portion of the hot gases in the heat-treating zone of the pellet firing machine can be generated by the process of the invention. The feeding ot the solid fuel is controlled in such a manner that there is solid fuel on the bed in the heat-treating zone at least in a part thereof in which the hot gases flow downwardly and in the cooling zone at least in a part thereof in which the gases flow upwardly and from which the heated cooling gases are supplied to the heat-treating zone. The solid fuel may be fed at one or more locations only in the heat-treating zone and in that case the particle size distribution and the feeding location are selected so that part of the fuel on the surface of the bed enters the cooling zone. Solid fuel particles below a certain size will be entrained in the cooling zone by the rising cooling gas and will be burnt in the cooling gas as it flows to the heat-treating zone. Any solid fuel which has been entrained by the cooling gas and has not been burnt until the cooling gas impinges on the surface of the pellet bed in the heat-treating zone will fall on the bed. Alternatively, the solid fuel may be fed both into the heat-treating zone and into the cooling zone, or only in the cooling zone. In that case the solid fuel will also be entrained by the gases in the cooling zone when its particle size has decreased below a certain value as a result of the combustion. Where solid fuel is fed into the cooling zone, any solid fuel which is fed in such a small particle size will be entrained by the gas immediately. The presence of solid fuel both in the heat-treating zone and in the cooling zone will result in a "multi-stage combustion" because the cooling gas emerging from the pellet bed on the cooling zone will be heated in the layer of solid fuel on the pellets by the combustion of solid fuel and will then be heated further by the combustion of entrained solid fuel in the gas flowing to the heat-treating zone and finally as the gas flows through the layer of solid fuel on the surface of the bed in that zone. As a result, there will be only small temperature differences in the gas stream so that the formation of slag from ash and dust and the thermally inducted formation of $NO_x$ will be greatly decreased.

The heated cooling gases rising from the pellet bed in the cooling zone are conducted under a common gas hood into the heat-treating zone, in which the hot gases flow downwardly, and the distribution of the hot gases is controlled by a control of the resistance to flow presented by the pellet bed. The resistance of the pellet bed to flow in each section of the heat-treating zone is controlled by an adjustment of the subatmospheric pressure in each section. In this case the gas can be distributed in the heat-treating zone without need for internal fixtures in the gas hood. As a result, a lower superatmospheric pressure in the cooling zone and a lower subatmospheric pressure in the heat-treating zone are sufficient so that the heat losses due to a leakage of hot gases and an infiltration of air are decreased too. Moreover, the coldest cooling gases coming from the last portion of the cooling zone flow in contact with the ceiling of the gas hood to protect the latter from high temperatures.

As an alternative embodiment, 40 to 80% of the fuel supplied from the outside is fed onto the surface of the pellet bed. That range will be particularly desirable if the gas hood has no internal fixtures in the heat-treating zone. This will result in particularly good operating conditions because a considerable part of the heat is generated with a uniform distribution on a larger area of the pellet bed. That part can be generated by inexpensive fuel. The remaining heat can be supplied by burners and can easily be controlled and the burner or burners required in the process for starting can be used for this purpose.

In existing plants in which internal fixtures are installed in the gas hoods in the heat-treating zone, about 10 to 40% of the fuel supplied from the outside is preferably fed onto the surface of the pellet bed. Solid fuel having a high content of volatile constituents is fed to the heat-treating zone and the thickness of the layer of the solid fuel and/or its particle size is so selected that the combustible constituents which have been volatized burn mainly in lower layers of the pellet bed. In this way the desired firing temperature is obtained also in the lower layers of the bed whereas the upper layers are not overheated. Besides, the duration of the treatment can be decreased. The larger the thickness of the layer formed by the solid fuel which has been fed and the larger its particle size, the more the volatile constituents are burnt in the lower layers of the pellet bed. Besides, the temperature in the upper layers of the pellet bed in the after-firing section can be decreased by a supply of hot gases at a lower temperature. The proportion of fines can be controlled so that part of the solid fuel falls through the interstices into lower layers and is completely burnt therein.

Figure 1:
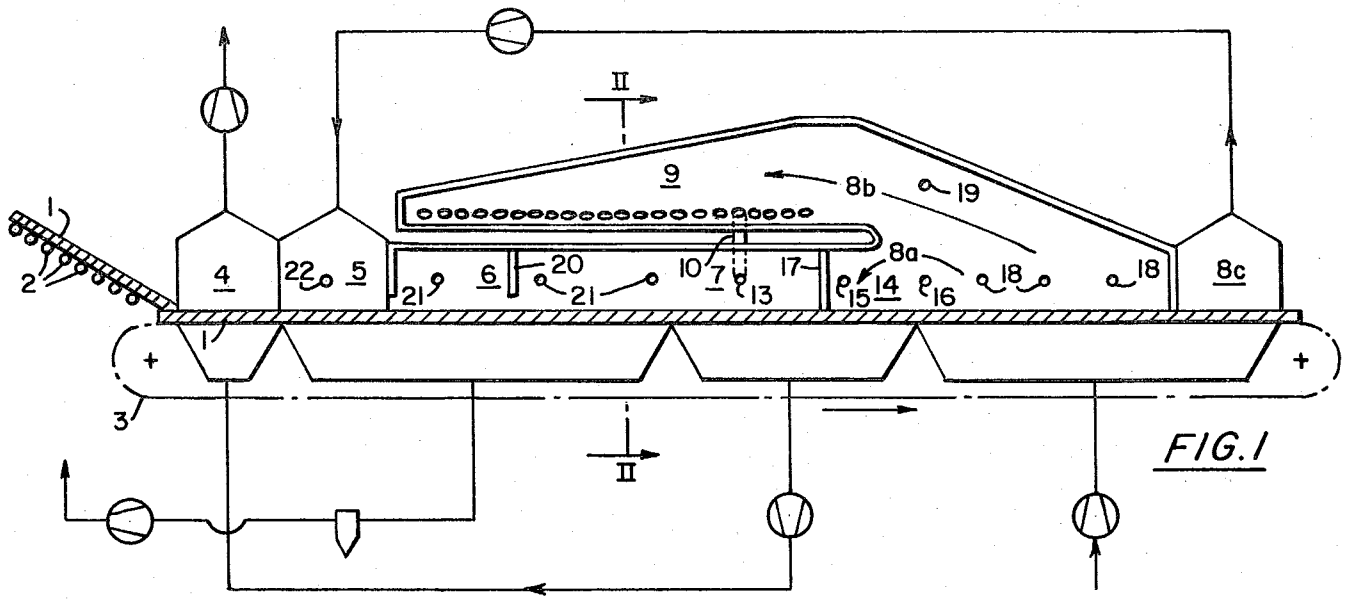
FIG. 1 is a diagrammatic longitudinal sectional view showing a pellet firing machine having internal fixtures in the heat treating zone.

Considering the drawings, the illustrated pellet-firing machine has a reaction area of 430 $m^2$ and includes a traveling grate having a width of 3.5 meters. Turning to FIGS. 1 and 2, unfired pellets 1 are charged by a roller conveyor 2 onto a traveling grate 3 and are dried by means of recycled process gases in an updraft drying section 4 and a downdraft drying section 5. In a preheating section 6 and a firing section 7, heated cooling gases are sucked through the pellet layer. The cooling gases are fed from the cooling zone section **8*b* through a recuperator duct 9 and thirty-eight feed ducts 10 to thirty-eight combustion chamber 11 and are heated up in the latter by means of thirty-eight oil burners 12 and are then delivered through combustion chamber outlets 13 to the preheating and firing sections. (For the sake of clearness, only one feed duct 10 and one combustion chamber outlet 13 are shown in FIG. 1.) In the afterfiring section 14, hot cooling gases from cooling zone section 8*a* are used to transfer heat from the upper to the lower part of the pellet bed. The afterfiring section 14 is separated from the firing section 7 by a weir 17, which prevents a direct access of cooling gases coming from zone sections 8*a* and 8*b* to the preheating section 6 and firing section 7**. In this way the pressure drop can be set up which is required for the flow of the cooling gases from the cooling zone to the above-mentioned sections.

The preheating and firing sections are separated by a weir 20.

The above described practice is in accordance with the known state of the art.

The following examples illustrate the process of the present invention:

EXAMPLE 1

Two metric tons of coal having particle sizes from 0 to 10 mm are fed at 15 and 16 into the afterfiring zone 14. It is assumed that coal is fed at such a rate that its combustion increases the temperature of the cooling gases by 200° C. This temperature increase is effected in steps, one of which consists of the combustion of the volatile constituents and extremely fine-grained particles of the fuel fed at 15. The heat which is thus generated is delivered in the underlying pellet bed to the cooling air and/or the pellet layer. The larger fuel particles fed at 15 burn on the surface of the pellet bed in the afterfiring zone, in which the gases flow downwardly. The voltatile constituents and extremely fine-grained particles of the fuel fed at 16 are burnt in the cooling gas flowing to the preheating section 14. The larger particles of the fuel fed at 16 are burnt on the surface of the pellet bed in a rising gas stream.

This partial combustion taking place at different locations (multistage combustion) results in a stepwise temperature increase so that hot spots which might cause a formation of slag (from the dust contained in the process gases and/or from the fuel ash) will be avoided or decreased just as the thermally inducted formation of nitrogn oxides ($NO_X$). This effect will be promoted by the uniform distribution of fuel and cooling gas on the pellet layer. This is due to the resistance presented by the pellet bed to the flow of the cooling gas so that the latter is supplied to the fuel in a very uniform distribution. There will be no large unblended areas in which hot spots can be formed. For this reason the combustion on the bed may be compared to the combustion of the fuel by means of a multitude of small burners.

As the preliminary experiments have shown, the larger fuel particles fed at 15 in an area in which the cooling gases from 8*a* flow downwardly lose weight as they are burnt in cooling gases coming from 8*a* and flowing downwardly. Those of said fuel particles which are not completely burnt are recirculated to the afterfiring section 14 from the transition to the cooling zone section 8*a* (in which the cooling gases flow upwardly) or from said cooling section. This recirculation is continued until the fuel particles ae completely burnt.

This arrangement affords the following advantages:

The afterfiring section 14 is additionally heated without a need for an attachment of additional feed ducts 10 to the recuperator duct 9 and of combustion chambers 11 provided with burners 12 and for a shifting of the weir 17 to the transition between the afterfiring section 14 and the cooling zone section 8*a*. This is due to the fact that the cooling gases from 8*a* are heated directly over the pellet bed by the fuel layer which lies on the pellet bed or is partly recirculated above said bed. In this way the additional pressure loss is avoided which would result from the larger volumetric gas rate entering the recuperator duct in the previous heating process carried out with the aid of feed ducts 10, combustion chambers 11 and burners 12. As a result, a lower pressure drop will be sufficient for the flow of the cooling gases from cooling zone section 8*b* to preheating section 6 and firing section 7 and there will be no additiional heat loss caused by cooling gas emerging from section 8*a* (at 750° C.) of the firing kiln and no air will infiltrate the sections 6 and 7 of the heat-treating zone. The additional heat required to heat the afterfiring section can be generated by inexpensive fuel which is available and accounts for about 14% of the fuel supplied from the outside.

EXAMPLE 2

In addition to the solid fuel fed at 15 and 16, 30% of the fuel supplied to the process from the outside is fed as solid fuel at 18, 19, 21 and 22 so that the solid fuel totals 44% of the fuel supplied from the outside. The fuel feeders 18 and 19 are supplied with oil as the plant is started up and are supplied with solid fuel when the plant has reached the operating temperature.

The fuel feeder 22 in the downdraft drying zone section 5 consists of a burner combination comprising a burner for solid fuel and an immediately succeeding burner for burning liquid for gaseous fuel or igniting the previously fed solid fuel. That burner unit 22 is operated as the plant is started up and/or during normal operation.

EXAMPLE 3

Figure 4:
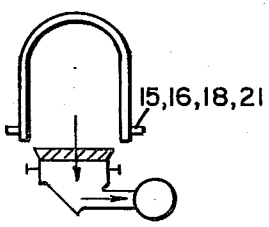
FIG. 4 is a cross sectional diagrammatic view of a pellet firing machine along lines IV—IV of FIG. 3.
Figure 3:
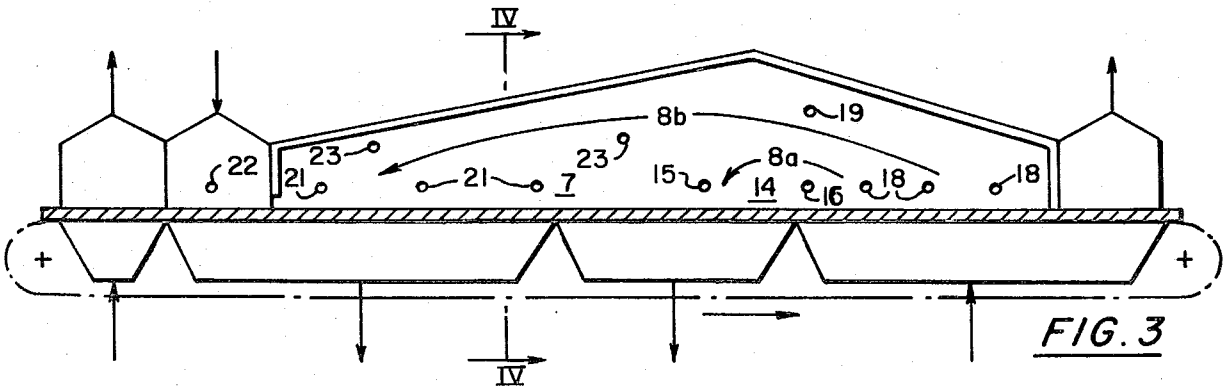
FIG. 3 is a diagrammatic longitudinal sectional view showing a pallet firing machine having no internal fixtures in the heat treating zone.

Turning now to FIGS. 3 and 4, the cooling zone 8*a*, 8*b* is directly connected with the afterfiring section 14 and the firing section 7 through a common gas hood having no internal fixtures. The solid fuel is fed through feeders 15, 16, 18, 21 and 22 and is burnt in several stages as described above for the afterfiring section. The volatile constituents and extremely fine-grained particles of that part of the coal which is fed through feeders 15, 21 and 22 in the region in which the gases flow downwardly, are burnt within the pellet bed. In this way, up to 100% of the fuel to be supplied from the outside may consist of solid fuel.

Preferably only 80% of the fuel supplied from the outside is fed through feeders 15, 16, 18, 21 and 22 and the supply of the remaining 20% through the feeders 19 and 23 is controlled to adjust the temperature of the cooling gas from section 8*b* as well as the rate at which the solid fuel burns on the cooling gas stream and on the pellet bed. To improve the control, the fuel feeders 19 and 23 are preferably used to feed pulverized coal, oil or hydrate alcohols. The liquid fuels are used mainly during starting up.

EXAMPLE 4

In this example, coal is only fed at 18 into the updraft cooling zone at such rates that the maximum permissible pressure loss between cooling and firing zone is not exceeded.

In an operation according to FIGS. 1 and 2, the maximum temperature for the refractory material of the cooling zone and the recuperator duct 9 is about 1200° C. Coal is supplied at such rates that the temperature of the cooling gas is raised to about 1100° C. Compared with a temperature of about 800° C. without feeding of coal at 18, this is an increase of about 300° C. and about 60% of gaseous or liquid fuel fed to the burners 12 can be substituted by the solid carbon. Even a temperature increase of 100° C. will result in a substitution of 20% of the fuel fed to the burners 12.

In an operation according to FIGS. 3 and 4 the cooling gases can be heated up to process temperature and up to 100% of the gaseous and/or liquid fuel fed to burners 12 according to FIGS. 1 and 2 can be substituted by solid fuel. In this case further feeders 19 for solid carbon are advantageous for distributing the combined combustion on the pellet bed and in the flow of the cooling gas as described in Example 1. In dependency of the feed rates and grain size distribution of the carbon a desired rate of combustion can be obtained before the heated cooling gases contact the pellets in the thermal treating zone. Furthermore, the temperature of the heated cooling gas can be kept lower at the beginning by appropriate selection of the site of feeders 19 and, as a consequence, the cross section of the gas hood can be kept smaller.

The advantages afforded by the invention reside in that local overheating at the burners and the resulting disadvantages can be substantially avoided. Even when only 10% solid fuels are fed, the burners can be operated at a lower rate and the disadvantages which have been described can be much reduced. The combustion of the gases in the fuel layer results in a very uniform heating of the gases so that the fuel layer can be compared to a multitude of burners. The gases can be even more uniformly heated in a plurality of successive stages. The thermally induced formation of $NO_x$ is much decreased and inexpensive fuels can be used. The volume of part of the gases is increased only as the gases are heated in the fuel bed and the heat transfer within the pellet bed is improved.

What is claimed is:

1. In a process for heat-treating pellets on a grate in a pellet firing machine having a heat-treating zone and a cooling zone wherein hot and cool gases respectively are passed through a pellet bed in each zone, hot gases being generated both by combusting fuel including outside fuel added after all of the pellets enter the heat treating zone and by conducting to the heat treating zone cooling gases which are heated as they are passed through said pellet bed in said cooling zone, the improvement comprising the steps of: charging solid carbonaceous fuel comprising at least part of the outside fuel onto the upper surface of the pellet bed, and burning said carbonaceous fuel to generate at least a portion of said hot gases in said heat-treating zone, with said hot gases flowing downwardly through the pellet bed in at least a portion of the heat treating zone and said cooling gases flowing upwardly through the pellet bed in at least a portion of the cooling zone, said cooling gases being heated for transfer into said heat treating zone, and with the particle size distribution and charging location of said solid carbonaceous fuel on the upper surface of said pellet bed being selected such that at least some of the fuel particles are lifted from the surface of the bed in the cooling zone by the upwardly flowing cooling gases with the smaller particles being consumed while the gases flow toward the pellet bed in the heat-treating zone and with the larger particles falling onto the upper surface of the bed in the heat-treating zone where they continue to burn.

2. In the process of claim 1 the improvement wherein said carbonaceous fuel charged onto the surface of the pellet bed comprises at least 10% of said outside fuel.

3. In the process of claim 2, the improvement wherein the particle size of said solid carbonaceous fuel is selected such that as particles on the surface of the pellet bed in the heat treating zone are burned, at least some of them fall down through the interstices between the pellets as they become smaller and continue to burn within the pellet bed.

4. In the process of claim 2, the improvement wherein at least some of said solid carbonaceous fuel is charged onto the upper surface of the pellet bed in the heat treating zone with the amount and particle size of said solid carbonaceous fuel being selected such that at least some of said particles are carried over into the cooling zone where they become entrained in the upwardly flowing cooling gases.

5. In the process of claim 4, the improvement wherein solid carbonaceous fuel is also added to the pellet bed in the cooling zone.

6. In the process of claim 1 wherein the transfer of heated cooling gas from the cooling zone to the heating zone is conducted through a common hood, the improved process wherein the distribution of the hot gases is controlled by controlling the resistance to flow presented by the pellet bed.

7. In the process of claim 6 wherein the solid carbonaceous fuel charged onto the surface of the pellet bed comprises about 40 to 80 percent of the fuel supply.

8. In the process of claim 4 wherein solid carbonaceous fuel having a high content of volatile constituents is fed to the heat-treating zone so that based on one or more of the following factors the combustible constituents which are volatized burn mainly in the lower layers of said pellet bed; said factors comprising: the thickness of the layer of said fuel charged onto said pellet bed and the particle size of said solid fuel.

9. In the process of claim 2, the improved process wherein said solid carbonaceous fuel is charged onto the surface of the pellet bed in the cooling zone.

* * * * *